US006098535A

United States Patent [19]

Lynn

[11] Patent Number: 6,098,535

[45] Date of Patent: Aug. 8, 2000

[54] HAND STAMP PRINTING OF NUMEROUS INDICIA BY INTERCHANGEABLE HOOK AND LOOP FASTENERS

[76] Inventor: Joy Lynn, 7061 Clairemont Mesa Blvd., Ste. 201-333, San Diego, Calif. 92111-1042

[21] Appl. No.: 08/757,922

[22] Filed: Nov. 27, 1996

[51] Int. Cl.[7] ..... B41K 1/08

[52] U.S. Cl. ..... 101/109

[58] Field of Search ..... 101/109

[56] References Cited

U.S. PATENT DOCUMENTS

| | | | |
|---|---|---|---|
| D. 266,257 | 9/1982 | Ahrens | 101/405 |
| 3,568,596 | 3/1971 | Mashburn | 101/415.1 |
| 3,661,078 | 5/1972 | Hammel | 101/125 |
| 3,832,947 | 9/1974 | Funahashi | 101/327 |
| 3,952,653 | 4/1976 | McFarland | 101/327 |
| 3,973,495 | 8/1976 | Rowe | 101/405 |
| 3,988,987 | 11/1976 | Ikura et al. | 101/327 |
| 4,172,419 | 10/1979 | Munyon | 101/405 |
| 4,182,241 | 1/1980 | Holtorf | 101/405 |
| 4,278,024 | 7/1981 | Pennington | 101/405 |
| 4,626,218 | 12/1986 | Wright | 434/73 |
| 4,706,564 | 11/1987 | Skopek | 101/111 |
| 4,823,691 | 4/1989 | Muller | 101/104 |
| 5,261,325 | 11/1993 | Bengtsson | 101/368 |
| 5,313,885 | 5/1994 | Winston | 101/405 |
| 5,359,932 | 11/1994 | Van Breene | 101/334 |
| 5,377,599 | 1/1995 | Wall et al. | 101/327 |

FOREIGN PATENT DOCUMENTS

| | | | |
|---|---|---|---|
| 861826 | 1/1971 | Canada | 101/415.1 |
| 1383859 | 11/1964 | France | 101/415.1 |
| 2700840 | 7/1978 | Germany | 101/368 |
| 94/15324 | 7/1994 | WIPO . | |

*Primary Examiner*—Edgar S. Burr
*Assistant Examiner*—Amanda B. Sandusky

[57] ABSTRACT

The invention is a method of making a stamp face (the imprinting part of the hand stamp consisting of letters, numbers and/or pictures) interchangeable, removable and re-attachable to the stamp mount. The device consists of a new use for hook and loop fasteners. The hook and loop fasteners, when permanently attached to the stamp face and the bottom of the stamp mount (handle) allow the user to attach and re-attach a stamp face or interchange stamp faces an unlimited number of times.

2 Claims, 1 Drawing Sheet

HAND STAMP PRINTING OF NUMEROUS INDICIA BY INTERCHANGEABLE HOOK AND LOOP FASTENERS

BACKGROUND OF THE INVENTION

1. Field of the Invention

This invention relates to hand stamps for imprinting on surfaces such as paper, fabric, leather, etc., specifically to an improved device and method for making a stamp with an interchangeable imprinter face.

2. Description of Prior Art

In the known art hand stamps have been made with an affixed stamp face. This restricted each mount's usefulness to one stamp face defined as a set of letters, numbers, and/or pictures, per mount, making it unnecessarily expensive to purchase one mount for each stamp face. Using one mount with only one stamp face takes up considerably more space than the invention, which by using one mount with unlimited stamp faces saves space and expenses. Heretofore many stamping devices have been invented in order to provide easy or convenient or detail or fast ink stamping.

One such stamp face, shown in U.S. Pat. No. 3,661,078 to Hammel (1970), shows a stencil hand stamp with fluid-containing handle and retractable supports. The entire device, however, limits itself to only one stamp face, or, only one combination of any letters, numbers and pictures, since it does not provide itself with a removable and reattachable system.

Funahashi, in U.S. Pat. No. 3,832,947 (1974) shows a simplified, self-inking hand stamp, but it also limits itself to only one stamp face since it does not perform any kind of interchangeability. Rowe, in U.S. Pat. No. 3,973,495 (1976) shows a hand stamp comprising a transparent base through which the stamp face is visible to the user. It is visible to the user, but it still limits itself to only one stamp face, since it does not interchange faces.

There is no prior art that allows stamp faces composed by any combination of letters, numbers and/or pictures to be interchanged.

SUMMARY OF THE INVENTION

Accordingly, several objects and advantages of the invention are to provide a maximization of stamp devices' usefulness and flexibility.

Also, because only one stamp mount is needed for unlimited stamp faces composed of letters, number and picture sets, it provides the users saving in space and expense. Still further objects and advantages will become apparent from a consideration of the ensuing description and accompanying drawings.

DETAILED DESCRIPTION OF PREFERRED EMBODIMENTS

Figure 1:
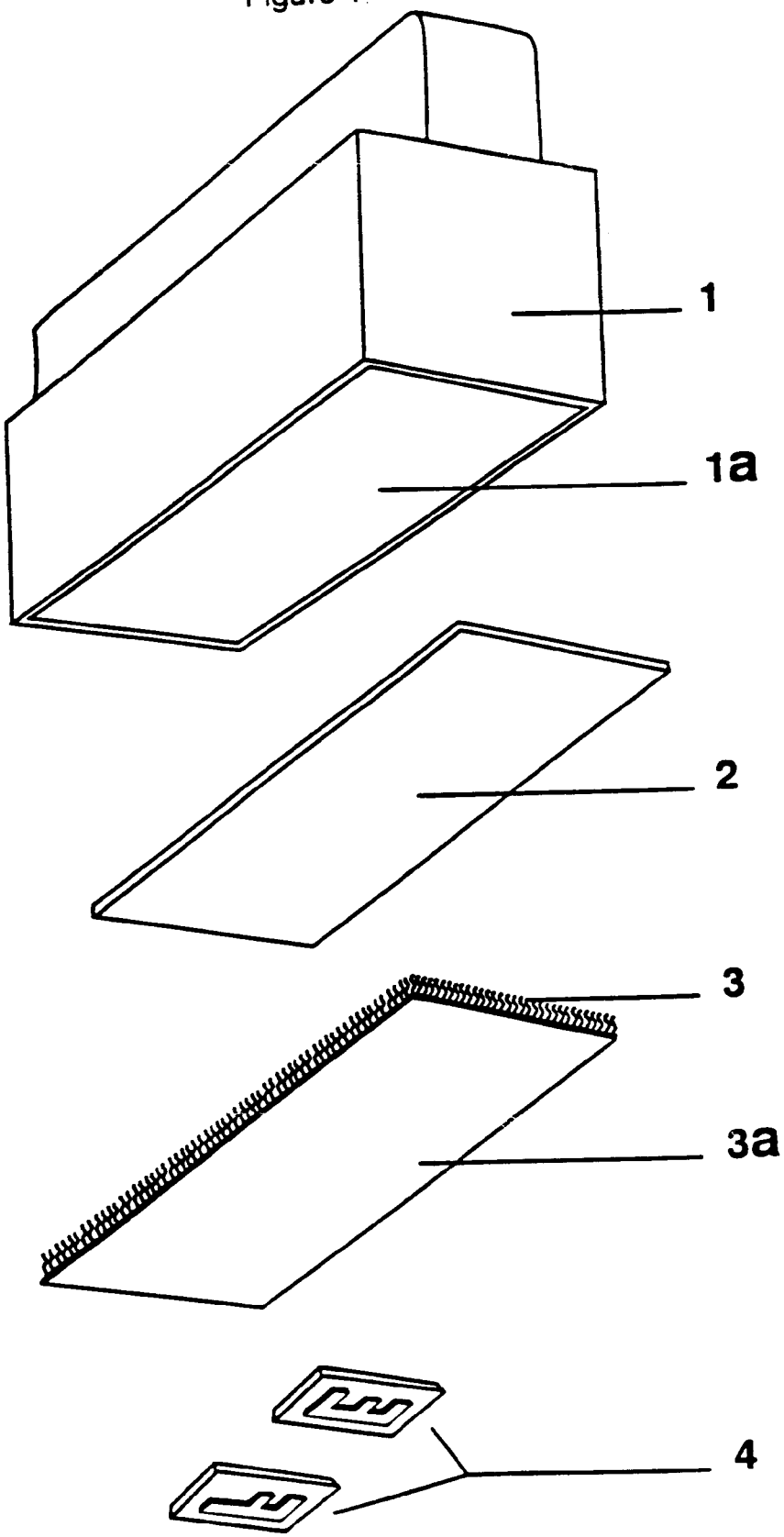
FIG. 1 shows an exploded view of a hand stamp of the present invention.

FIG. 1 shows an exploded view of a hand stamp used for imprinting letters, numbers and/or pictures on any surface such as paper, fabric, leather, canvas, etc. The stamp is composed of 4 distinct parts.

The mount (1) is the mount or handle which the user holds in their hands and uses to press down the stamp face on the ink pad, then the surface to be imprinted upon.

The stamp face or indicia (4) is composed of one or any combination of letters, numbers or pictures attached by the invention to the mount, and prints on any desired surface such as paper, fabric, leather, canvas, etc.

The hook and loop fastener* is a standard fastening component designed for repeated opening and closing life cycle. The hook and loop fastener is composed of two parts: a hook and a loop. The loop fastener (2), or female section, is a tape covered with tiny, soft loops. The hook fastener (3) is the male section of the attaching and reattaching device. It is a tape covered with stiff little hooks. When pressed together, the hooks and loops engage, creating an adjustable, highly versatile and secure closure. To open, it is simply peeled apart. Hook and loop fasteners can be opened and closed many thousands of times.

*Hook and loop fasteners include but are not limited to:

| | |
|---|---|
| ASTRO-VELCRO | SOFT HARDWARE |
| BURRTAPE | SOFTILES |
| CORD CONTROL | STICKYBACK |
| EDGECLIP | TENDER STRAP |
| ELASTOGRIP | TEXACRO |
| FASTEN-ALL | TOUCH'N HOLD |
| FASTEN-ATING | TOUCH AND CLOSE |
| GARBAGE GARD | ULTRA-MATE |
| GENUINE VELCRO | UP THE WALL |
| BRAND TOYS | VEL-LOC |
| GRIP-LOK | VEL-SEAL |
| HANG UPS | VEL-SQUARE |
| HI-AIR | VEL-STRETCH |
| HI-GARDE | VELCINCH |
| HI-MEG | VELCOIN |
| HOLD A COIL | VELFOAM |
| K LOOP | VELOK |
| KNITLOK | VELSTICK |
| MID-TEMP | VELSTRAP |
| OMNI-TAPE | VELSTUD |
| ONE-WRAP | VELTEX |
| PAPER BUOY | VELTRACK |
| POP-IN | WRAP-A-STRAP |
| RESSCO | VELCRO |

All the above mentioned are registered trademarks

The invention is the method of using the hook and loop fasteners to create a new method of attaching and detaching an unlimited number of stamp faces to only one stamp mount.

The invention is also a device that brings a new use for the hook and loop fasteners: it allows the attaching and detaching of an unlimited number of stamp faces to only one stamp mount.

FIG. 1 shows a plan view of a base stamp composed of 4 distinct parts:

The mount (1) is the main part which the user holds to and presses down in order to get the stamp face (4) (composed by any combination of letters, numbers and/or pictures) printed on any desired surface.

The VELCRO loop (2) is glued to the base **(1*a*) of the mount (1)**.

The VELCRO hook (3), with any stamp face (4), glued to its smooth side **(3*a*), can be attached and unattached to VELCRO loop (2) as desired, according to the stamp face (4)** needed by the user.

Operation and use of the interchangeable face stamp functions effectively as follows: When loop fastener (2) and hook fastener (3) are added to a stamp mount of any kind, they enable stamp mounts to have unlimited interchangeable and reattachable faces. This allows the user to have only one stamp mount (1) for an unlimited number of stamp faces as needed The loop fastener (2) will be firmly attached (glued) to bottom of mount (1*a*), allowing the hook fastener (3), which carries the stamp face (4), to be placed and removed onto and from loop fastener (2) at any given time. Alternately, the hook fastener (3) could be attached to bottom of mount (1*a*), and the loop fastener (2) would have the face glued to it, performing the same task. The stamp face composed of any combination of letters, numbers or pictures can be attached with glue or adhesive tape to the hook fastener. The hook fastener (3) can be attached and unattached from the loop fastener (2), which is affixed to the base of the mount (1*a*)

Accordingly, it can be seen that a method and a device has been invented providing the interchangeability of multiple stamp faces which attach to only one mount, operates simply, efficiently, makes ink imprinting, stamping and/or labeling easy and increases the usefulness of a single stamp mount of any kind.

Although the description above contains many specificities, these should not be construed as limiting the scope of the invention but as merely providing illustrations of some of the presently preferred embodiments of this invention. Various other embodiments and ramifications are possible within its scope. For example, the same stamp mount can be used to date, check in/out, and identify a specific department where a letter/document has been, providing saving of space and expense. Thus the scope of the invention should be determined by the appended claims and their legal equivalents, rather than by the examples given.

What is claimed is:

1. A method of printing indicia on any printable substance, said method comprising the steps of:

a) providing a hand stamp mount having a flat base, b) providing hook and loop fastener material, c) attaching one element of said hook and loop fastener material to said flat base, d) providing a supply of a plurality of removable, interchangeable and reusable stamp faces having a flat back surface and a front surface having indicia thereon which can be used and reused to form the indicia to be printed on any printable substance, e) securing the other element of said hook and loop fastener material to the back surface of the stamp faces, f) selecting at least one stamp face required to form a first desired indicia and mounting said at least one stamp face on said flat base by engaging said hook and loop fastener material, g) printing the first desired indicia, h) removing the said at least one selected stamp face from said flat base, i) selecting at least one different stamp face required to form a second desired indicia different from said first desired indicia and mounting said at least one different stamp face on said flat base by engaging said hook and loop fastener material, j) printing the second desired indicia, k) removing said at least one different selected stamp face from said flat base, Whereby hand stamp printing of any of a number of a desired indicia on said printable substance is accomplished by attaching and detaching by hook and loop fasteners respective selected interchangeable flat back surface stamp faces.

2. A method of printing indicia on any printable substance, said method comprising the steps of:

a) providing a hand stamp mount having a flat base.

b) providing hook and loop fastener material, c) attaching one element of said hook and loop fastener material to said flat base, d) providing a supply of a plurality of removable, interchangeable and reusable stamp faces having a flat back surface and a front surface having indicia thereon which can be used and reused to form the indicia to be printed on any printable substance, e) securing the other element of said hook and loop fastener material to the back surface of the stamp faces, f) providing a means to select at least one stamp face required to form a first desired indicia and mounting said at least one stamp face on said flat base by engaging said hook and loop fastener material, g) providing a means to print the first desired indicia, h) providing a means to remove the said at least one selected stamp face from said flat base, i) providing a means to select at least one different stamp face required to form a second desired indicia different from said first desired indicia and mounting said at least one different stamp face on said flat base by engaging said hook and loop fastener material, j) providing a means to print the second desired indicia, k) providing a means to remove said at least one different selected stamp face from said flat base, Whereby hand stamp printing of any of a number of a desired indicia on said printable substance is accomplished by attaching and detaching by hook and loop fasteners respective selected interchangeable flat back surface stamp faces.

* * * * *